US006039639A

United States Patent [19]

Pfaundler

[11] Patent Number: 6,039,639

[45] Date of Patent: Mar. 21, 2000

[54] MOTOR DRIVEN HAND TOOL WITH IMPROVED ELASTIC SUPPORTING MEMBERS CONNECTING AN OSCILLATING WORK TOOL CARRIER WITH THE TOOL HOUSING

[75] Inventor: Julian Pfaundler, Gerlingen, Germany

[73] Assignee: Robert Bosch GmbH, Stuttgart, Germany

[21] Appl. No.: 09/027,274

[22] Filed: Feb. 20, 1998

[30] Foreign Application Priority Data

Feb. 27, 1997 [DE] Germany ..... 197 07 938
Jan. 2, 1998 [DE] Germany ..... 198 00 042

[51] Int. Cl.[7] ..... B24B 23/04

[52] U.S. Cl. ..... 451/356; 451/351

[58] Field of Search ..... 451/356, 351, 451/357

[56] References Cited

U.S. PATENT DOCUMENTS

| | | | |
|---|---|---|---|
| 2,639,564 | 5/1953 | Atkin | 451/357 |
| 3,136,099 | 6/1964 | Tully et al. | 451/356 |
| 3,418,761 | 12/1968 | Sheps | 451/356 |
| 3,533,193 | 10/1970 | Dudek et al. | 451/356 |
| 3,900,974 | 8/1975 | Klebe, Jr. et al. | 451/357 |
| 4,686,797 | 8/1987 | Hoffmann | 451/356 |
| 4,729,194 | 3/1988 | Maier et al. | 451/357 |
| 5,511,271 | 4/1996 | Shishido et al. | 15/49.1 |
| 5,595,530 | 1/1997 | Heidelberger | 451/356 |

FOREIGN PATENT DOCUMENTS

| | | |
|---|---|---|
| 0 404 133 A2 | 12/1990 | European Pat. Off. . |
| 38 05 926 A1 | 9/1989 | Germany . |
| 40 38 634 A1 | 6/1991 | Germany . |
| 93 20 393 U | 7/1994 | Germany . |

*Primary Examiner*—Timothy V. Eley
*Attorney, Agent, or Firm*—Michael J. Striker

[57] ABSTRACT

A motor driven hand tool has an oscillatory work tool carrier (10) that is attached by means of elastic supporting members (11 to 14) to the housing. Each elastic supporting member (11 to 14) includes a one-piece plastic part consisting of approximately rod-shaped spring elements (20 to 25) and transversely extending base parts at opposite ends of the spring elements. At least one damping part (29) may be provided extending between the spring elements (20 to 25) and bears on or is supported between both base parts (15,26). The base parts of the one-piece plastic part contact on respective facing surfaces of and are formed for releasable attachment with the hand tool housing and the work tool carrier.

13 Claims, 5 Drawing Sheets

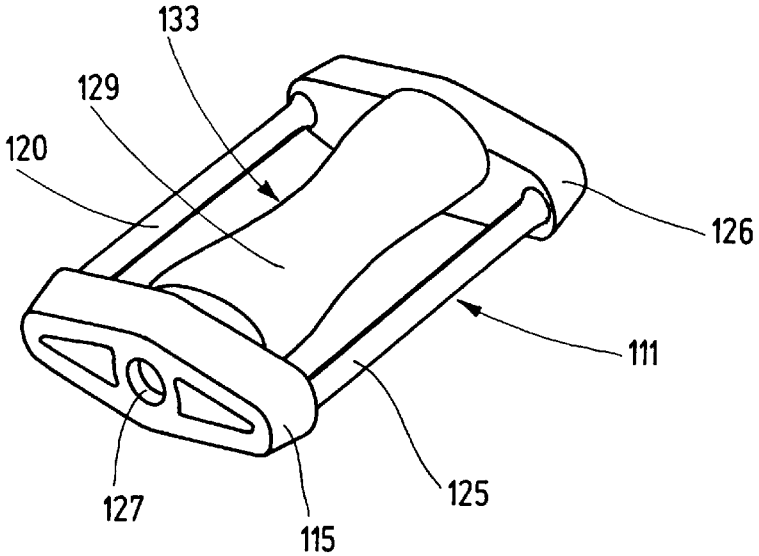
Fig. 6
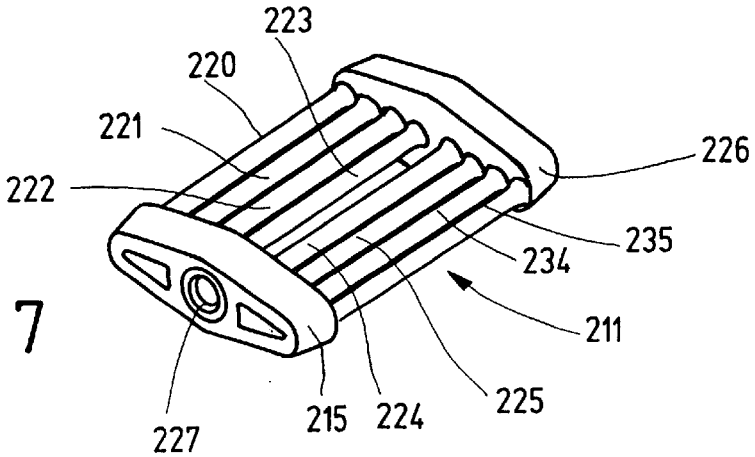
Fig. 7
Fig. 8
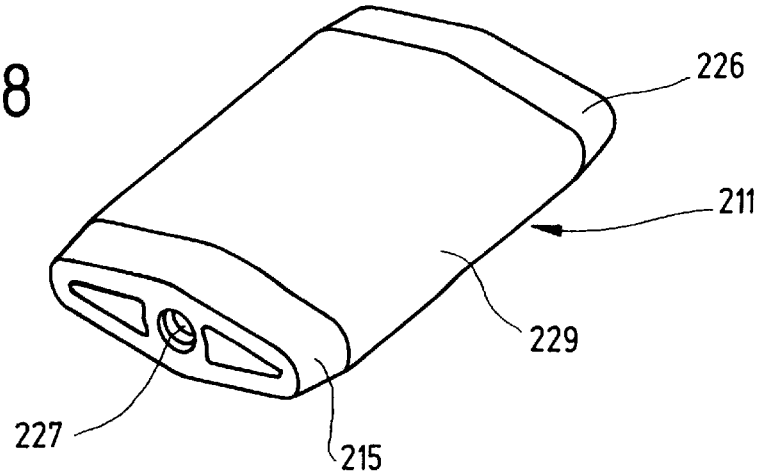

MOTOR DRIVEN HAND TOOL WITH IMPROVED ELASTIC SUPPORTING MEMBERS CONNECTING AN OSCILLATING WORK TOOL CARRIER WITH THE TOOL HOUSING

BACKGROUND OF THE INVENTION

The present invention relates to a motor driven hand tool and, more particularly, to a motor driven hand tool, especially an oscillating grinder, which comprises a hand tool housing, an oscillator work tool carrier mounted on the hand tool housing, at least one elastic supporting member connected to the hand tool housing to hold the work tool carrier on the hand tool housing, the at least one elastic supporting member having at least one approximately rod-like spring element.

A motor driven hand tool of this type is described in German Patent Document DE 93 20 393 U1. One piece elastic supporting members directly or indirectly connected to the work tool carrier are provided in this motor driven hand tool, which prevent the work tool carrier from falling off or prevent rotation. These supporting members include front and rear oscillating elements, of which the front has four individual oscillating columns and the rear has three individual oscillating columns, which are connected in one-piece by an upper transverse member. Because of that the individual supporting members each nearly have a T-shape. The individual oscillating columns each form an approximately rod-shaped spring element, which is loaded with compression force in a direction along its rod-like body and transverse force acting across that direction. The supporting members hold the oscillating work tool carrier in the housing, so that the work tool carrier can perform an orbital motion by means of an eccentric when it is driven.

The one-piece structure of the supporting member provides the disadvantage that the form of the hand tool regarding the location of the supporting member, the form of the work tool carrier, the form of the hand tool housing and the like, are limited. Furthermore this leads to additional limitations of the possible embodiments for the supporting members. The hand tool has the additional disadvantage that the work tool carrier in one-piece with the supporting members and/or a part of the hand tool connected with it must be replaced when the supporting member or members are damaged. Because of the rod shape of the individual spring elements they are in a position to take compression forces and at the same time transverse forces and to hold the work tool carrier fixed in the housing with a predetermined spacing in the rod longitudinal direction along the spring elements only because of that.

Elastic supporting members in the form of approximately column-like cylindrical parts for holding the work tool carrier in the housing are included in other motor driven hand tools which are described in German Patent Document DE 38 05 926 A1. These supporting members are formed as rubber connectors with a waist in the vicinity of their longitudinal center (as in DE 40 38 634 A1) or this elastic member has a transverse filling at one end so that at least a weak S-shaped behavior results (EP 404 133 S2). Primarily the elastic supporting member fits in the housing at one end and in a cup-like recess in the work tool carrier at the other end, so that the supporting member can be changed or replaced in case of damage. Because of the form of the elastic material the supporting members thus formed have damping properties so that vibrations are damped and the hand tool runs more smoothly because of these damping properties. It is disadvantageous however to form the supporting members from elastic material because the deformability of these supporting members is comparatively strong and responsive. It is also disadvantageous that elastic supporting members do not permit geometrically precise positioning of the work tool carrier and because of that an expensive positioning and mounting of the drive shaft with increased costs is required. Furthermore elastic supporting members lead to power losses because of their deformability that must be compensated by a greater motor power.

SUMMARY OF THE INVENTION

It is an object of the present invention to provide an improved motor driven hand tool of the above-described type, especially an oscillating grinder, which does not have the above-described disadvantages.

This object, and others which will be made more apparent hereinafter, are attained in a motor driven hand tool, especially an oscillating grinder, which comprises a hand tool housing, an oscillator work tool carrier arranged on the hand tool housing, at least one elastic supporting member connected to the hand tool housing and to the work tool carrier to hold the work tool carrier on the hand tool housing, the at least one elastic supporting member having at least one approximately rod-like spring element.

According to the invention the at least one elastic supporting member has transversely extending base parts at opposite ends of the at least one approximately rod-like spring element, and the base parts are in one piece with the at least one approximately rod-like spring element, and means for releasably attaching the at least one supporting member to the hand tool housing and the work tool carrier.

The motor driven hand tool according to the invention has many advantages. The at least one supporting member provides an independent replaceable or exchangeable component. Because of that the freedom to make additional choices regarding the form of the work tool carrier and/or the housing and furthermore in regard to the form of the supporting member is increased. The arrangement of several supporting members in the hand tool may be simplified and improved. The spring elements are in a position to stand both compression and also tension as well as bending and torsion and to take the corresponding forces acting on them so that the at least one supporting member according to the invention can guide and position the work tool carrier very accurately and is characterized by an optimum bending stiffness and simultaneously very easy construction. A satisfactory support of the at least one spring element occurs on attachment of the at least one supporting member because of the transversely extending base parts bearing on the work tool carrier and the hand tool housing. The at least one supporting member is simple and economical and is useable in various motor driven hand tools, e.g. in oscillatory grinders or other hand grinding or sanding units.

Other advantageous embodiments of the invention are described in the dependent claims appended hereinbelow. A combination of a very rigid axial spring element with a suitable damping element in the at least one supporting member provides a supporting member which can take transverse and torsion forces and at the same time perform a damping function. This additional damping provides a very smooth running hand tool. Furthermore no increase in nominal motor power in comparison to known hand tool devices is required to cover power losses caused be deformability.

It is advantageous when both base parts are formed equal. Passages or screw domes through the base parts can be provided approximately extending up to the longitudinal center of the base part and can contain in an advantageous manner threaded sleeves, e.g. made from metal. Both base parts can be formed as flat parts connected with each other by means of two or more spring elements extending approximately parallel to each other. It is of advantage when the at least one supporting member has two or more spacing elements extending approximately parallel to each other.

It is advantageous when a center part of the supporting member is attached to the base parts, e.g. by screws, foam or injection molding. The center part can extend approximately along the passages or the screw domes of the base parts. In an advantageous manner the damping part is formed by foaming outside of and around the at least one spring element. It is also advantageous when the damping part is made from rubber, foam, an elastomer or the like. Four equal supporting members can be provided in a four cornered arrangement in a preferred embodiment. It is particularly of advantage when the individual supporting members extend with their base parts at an angle between 0° and 90°; preferably between 15° and 45° in relation to the longitudinal center line of the work tool carrier. The individual supporting members can be arranged around a circle spaced from each other, whose center coincides with the central axis of the hand tool. It is of advantage further when several equal supporting members are arranged in the form of at least one circular ring or in series or in a row on at least one straight line.

BRIEF DESCRIPTION OF THE DRAWING

The objects, features and advantages of the invention will now be illustrated in more detail with the aid of the following description of the preferred embodiments, with reference to the accompanying figures in which:

FIG. 6 is a schematic perspective view of one of the elastic supporting members according to a second embodiment, FIG. 7 is a schematic perspective view of one of the elastic supporting members according to a third embodiment and prior to finishing, FIG. 8 is a schematic perspective view of the elastic supporting member of FIG. 7 after its completion.

DESCRIPTION OF THE PREFERRED EMBODIMENT

Figure 1:
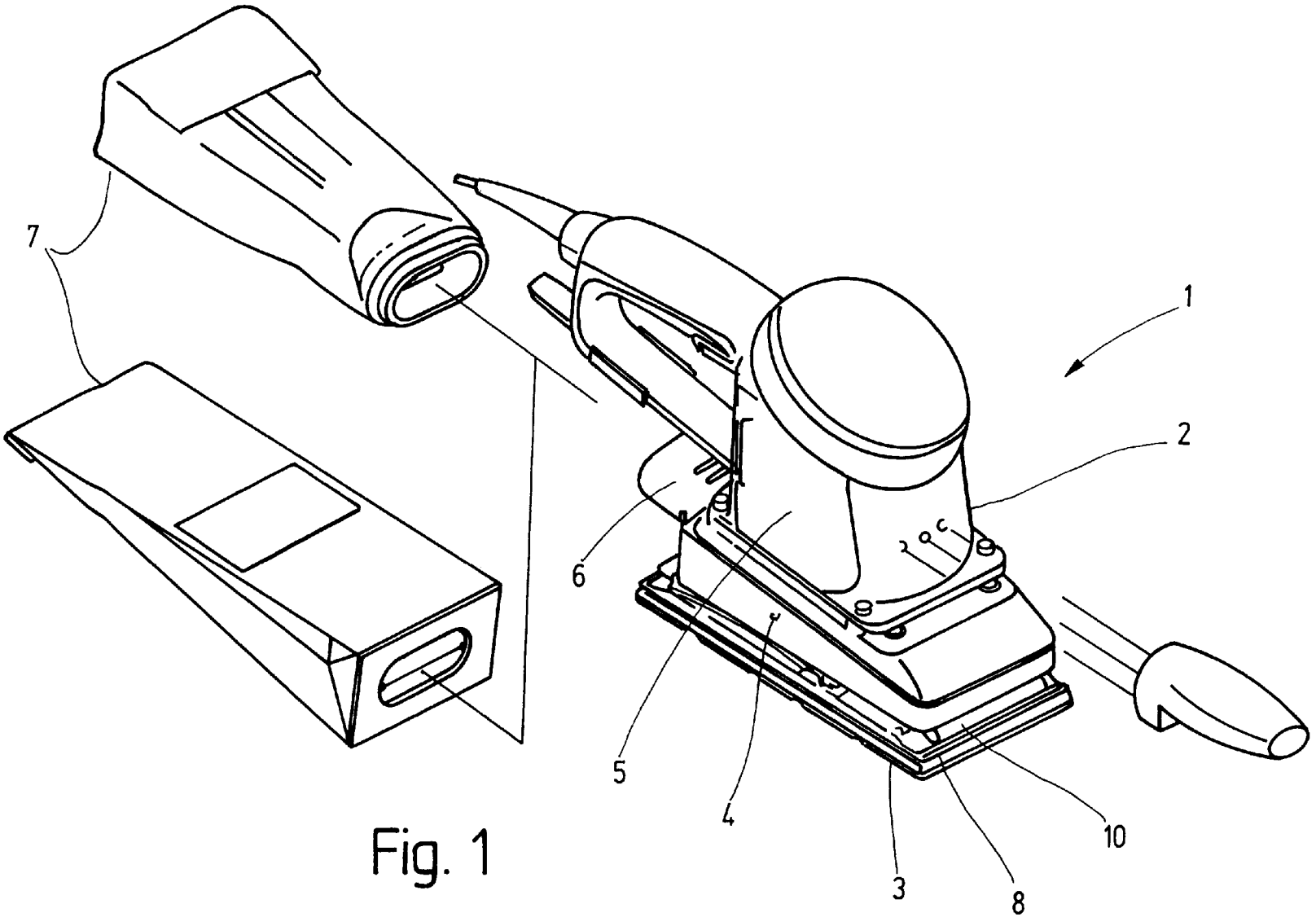
FIG. 1 is a schematic perspective view of a motor driven hand tool.

FIG. 1 shows an electrical hand tool 1, which is designed as an oscillatory grinder and has a hand tool housing 2, in which a drive motor, which is not shown in further detail, for driving the plate-like work tool carrier 10 is held in the usual manner. A grinding sheet 3 is attachable to the work tool carrier 10. The hand tool housing 2 has an approximately box-like housing part 4 and a remaining housing part 5. The approximately box-like housing part 4 is arranged above the work tool carrier 10 next to it. The housing part 4 in the usual manner contains an unshown fan inside it driven by the motor and an interior chamber. Air for cooling the gears and motor and/or for dust removal is circulated with the fan in the interior chamber to a dust exhaust device, which is provided with a dust exhaust connector 6. A dust container 7, e.g. in the form of a bag and/or pipe device, is releasably connected to the dust exhaust connector 6.

Figure 2:
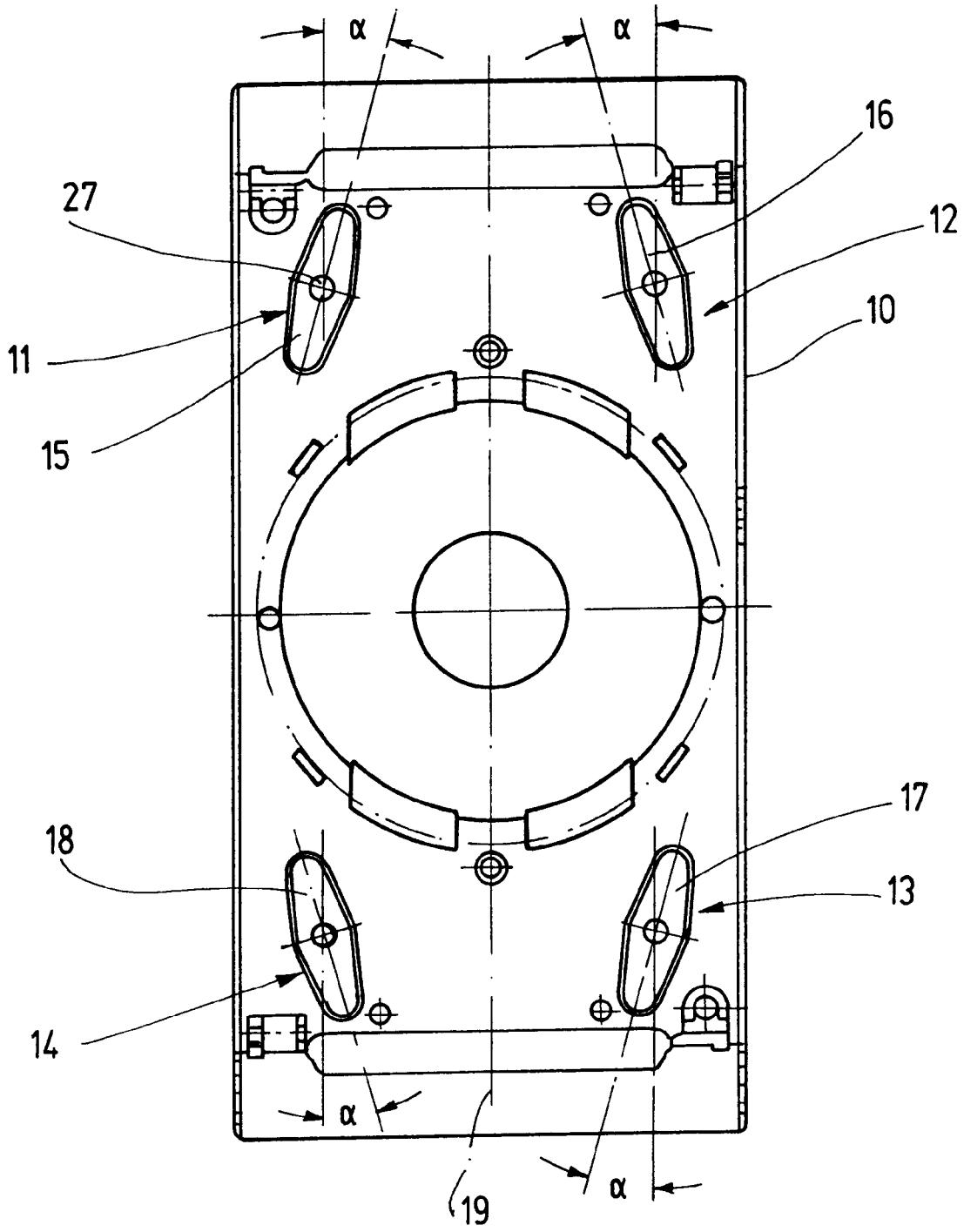
FIG. 2 is a schematic plan view of a work tool carrier of a hand tool with four elastic supporting members.

The plate-like work tool carrier 10 of the motor driven hand tool 1, especially an oscillatory grinder, is shown in FIG. 2. The plate-like work tool carrier 10 is driven by an unshown eccentric device connected to it by the motor in the housing 2 by means of an unshown motor shaft and executes an orbital motion. A grinding plate 8 is provided on the under side of the plate-like work tool carrier 10. The work tool carrier 10 is connected to and held on the stationary housing 2 of the hand tool 1 by means of the supporting members 11 to 14, and of course is restrained in relation to motion perpendicular to the plane of the work tool carrier 10 and also transversely to it so that rotation is hindered. Each supporting member 11 to 14 is elastically deformable and is connected on the one hand to the hand tool housing 2 and on the other hand to the work tool carrier 10.

In the embodiment according to FIG. 2 at least four supporting members 11 to 14 are provided in a four cornered arrangement. The supporting members are equal and each is provided with a visible base part 15 to 18. The individual support members 11 to 14 are each extend at an angle a in relation to the longitudinal edge of the work tool carrier 10, i.e. they are inclined in relation to the longitudinal central axis 19. The inclination angle a amounts to about 15° in the indicated embodiment. Generally it can be between 0° and 90°; preferably between 15° and 45°. The individual supporting members 11 to 14 are all constructed equal and exchangeable with each other. Individual details of these supporting members 11 to 14 are shown in more detail in FIGS. 3 to 5 for a first embodiment.

The supporting member 11 can have at least one approximately rod-like spring element. In the embodiment shown in FIGS. 3 to 5 it has six approximately rod-like spring elements 20 to 25, which extend spaced from each other and approximately parallel to each other and which, as shown in FIG. 5 especially, are arranged in a row or in series one after the other. The supporting member 11 has a base part 15 and 26 at both opposite ends of individual spring elements 20 to 25. The base parts 15 and 26 extend transversely across the supporting member. Both base parts 15 and 26 are in one piece with the spring elements 20 to 25 connecting them with each other. This one-piece component is formed as a plastic part. The individual spring elements 20 to 25 have a circular cross-section. They are axially very rigid springs, preferably with a strength-optimized shape or contour. Both base parts 15 and 26 are formed for releasable attachment of the supporting member 11 to the work tool carrier 10 and to the hand tool housing 2, on which they can contact with their respective facing surfaces.

The base parts 15 and 26 are provided with passages 27 and/or 28 for engagement in an unshown manner with attaching screws. In other unshown embodiments threaded sleeves, e.g. made of metal, can be contained in the passages 27 and/or 28, which for example can be subsequently pressed into the passages. The passages 27 and 28 are provided approximately in the longitudinal center of the respective base parts 15 and 26. The base parts 15,26 are equal flat parts extending parallel to each other and connected with each other by the spring elements 20 to 25, as, for example, can be seen from the shape of the base parts 15, 26 shown in FIG. 3.

Figure 3:
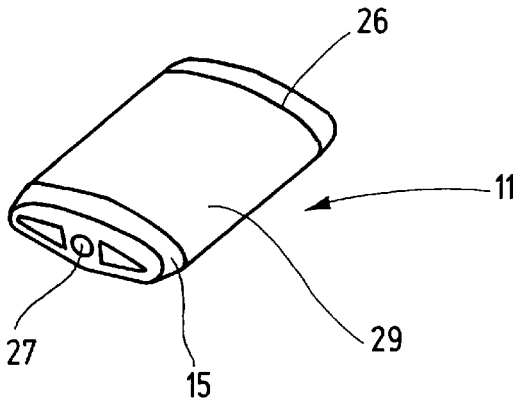
FIG. 3 is a schematic perspective view of one of the elastic supporting members according to a first embodiment.
Figure 4:
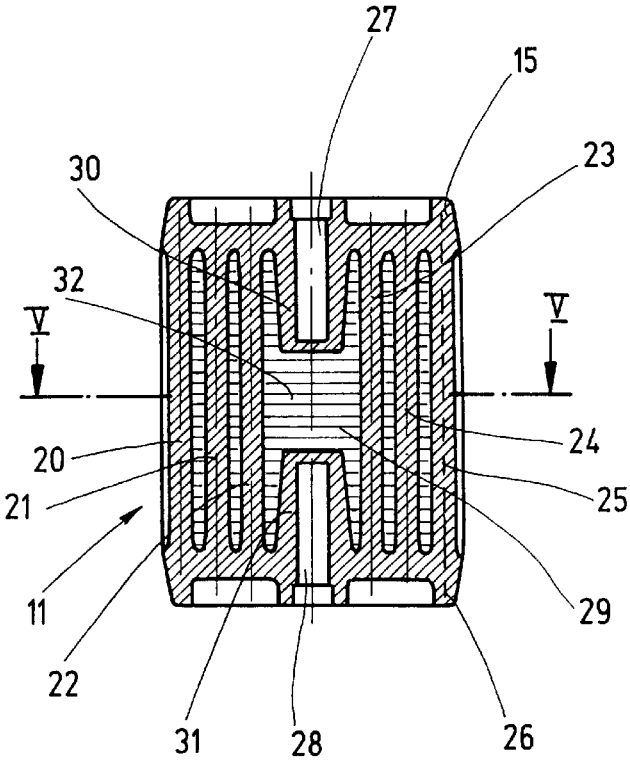
FIG. 4 is a detailed longitudinal cross-sectional view through the elastic supporting member of FIG. 3.
Figure 5:
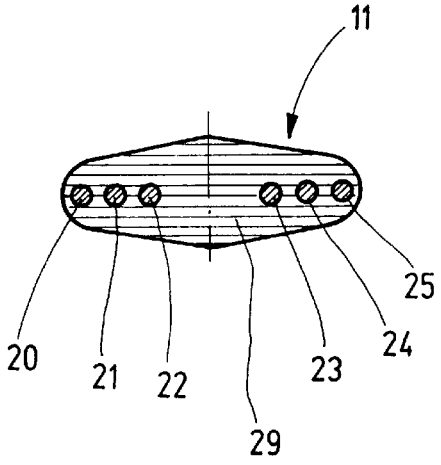
FIG. 5 is a schematic cross-sectional view through the supporting member of FIG. 3 taken along the section line V—V in FIG. 4.

A preferably single-piece damping part 29 is provided inside and outside between the individual spring elements 20 to 25 in the supporting member 11 and the other supporting members 12 to 14 according to the first embodiment in FIGS. 2 to 5. The single-piece damping part 29 bears or is braced on both base parts 15 and 26 in the direction of extension of the spring elements 20 to 25 and extends from the one base part 15 to the other base part 26. The damping part 29 fills the region between the individual spring elements 20 to 25 and forms an outer jacket between the base parts 15 and 26. This damping part 29 can be arranged in one or several pieces and fit without rigid connection between the spring elements 20 to 25 and/or the base parts 15 and 26. Alternatively this damping part 29 can instead be rigidly connected with the base parts 15,26 and the spring elements 20 to 25, e.g. by an adhesive, glue or the like. It is of particular advantage when the damping part 29 is formed by foam at least around the spring elements 20 to 25 and is made from rubber, foam, an elastomer or the like. As shown from the cross-section of FIG. 4, the passages 27 and 28 are provided in screw domes 30,31, which are formed in one piece with the base parts 15,26. These screw domes extend from the respective base parts approximately parallel between the spring elements 22 and 23 and thus end with spacing from each other. The intervening spacing 32 between the screw domes 30,31 is filled by material of the damping part 29. The supporting member 11 in the embodiment described according to FIGS. 3 to 5 provides a foamed oscillating spring with integrated damping, in which the base parts 15,26 with the screw domes 30,31 and the spring elements 20 to 25 form a one-piece plastic insert, which are embedded in foam filling the region between the spring elements 20 to 25. The damping part 29 is either rigidly connected with this plastic insert or is simply fit in this region without connection to these parts. This supporting member 11 thus provides a combination of very rigid axial springs as elements of the plastic insert with a damping part 29. This supporting member 11 can take transverse force and torsion forces and has simultaneously a damping function so that, because of that, a resilient or spring-damping element results. The spring element responds both to pressure and also to tension, bending and torsion. It is thus possible to guide the work tool carrier 10 very accurately axially and to position it. It is characterized by optimum bending stiffness and simultaneously very easy construction. The hand tool 1 has a very smooth running action because of the damping part 29. Possible power losses based on deformability are not noted, so that no nominal additional motor power is required.

In the embodiment shown in FIG. 6 parts which correspond to parts in the first embodiment are provided with a reference number equal to that in the first embodiment plus 100.

The supporting member 111 in FIG. 6 has two base parts 115 and 126 and spring elements 120 and 125 extending approximately parallel to each other between them, which form a one-piece plastic part with the base parts 115,126. The base parts 115, 126 contain passages, of which only the passage 127 in the base part 115 is visible. The passages may contain screw domes or screw domes of this type can be omitted. A damping part 129, which is formed here from a central part 133, extends inside and between both base parts 115, 126 spaced from both spring elements 120,125. The central part 133 extends from one base part 115 to the other base part 126 and is supported by both of them. The central part 133 is placed between the base parts 115, 126 and extends with transverse distance between them. The central part 133 is at least slightly constricted or provided with a slight waist in the vicinity of its longitudinal center. It is attached to the base parts 115, 126, e.g. by screwing or in some other way. The central part 133 extends in the same direction as the passage 127. The central part 133 formed as damping member 129 is made from rubber, foam, an elastomer or the like.

A third embodiment of the supporting member 211 is shown in FIG. 7. It is used in this state or also as a finished component. The supporting member 211 does not have a damping part and comprises base parts 215,226 at both ends and eight approximately parallel spring elements 220 to 225, 234 and 235 extending between the base parts. If this supporting member 211 of FIG. 7 should have integrated damping, a damping part 229 made of suitable material is provided outside of and around the spring elements 220 to 225, 234 and 235 by foaming, as is shown in the finished component in FIG. 8.

Figure 9:
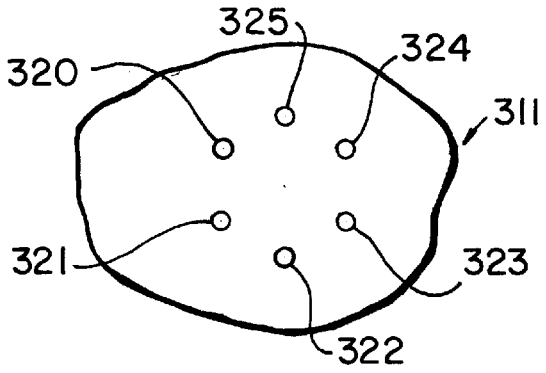
FIG. 9 is a schematic cross-sectional view through another embodiment of the supporting member shown in FIG. 5 in which the spring elements are arranged in a circle.
Figure 10:
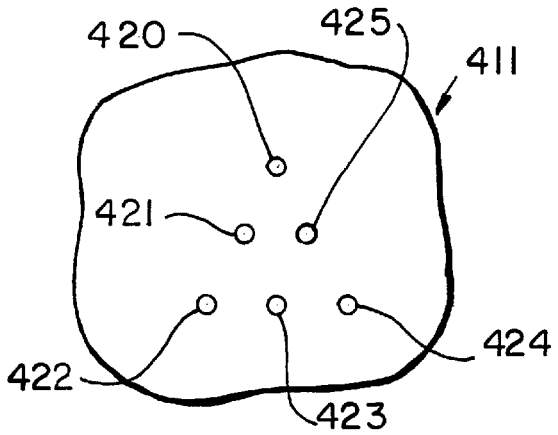
FIG. 10 is a schematic cross-sectional view through an alternative embodiment of the supporting member shown in FIG. 5 in which the spring elements are in a triangular arrangement.
Figure 11:
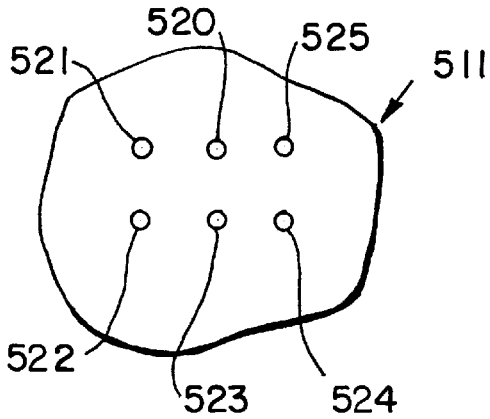
FIG. 11 is a schematic cross-sectional view through an additional embodiment of the supporting member shown in FIG. 5 in which the spring elements are in a rectangular arrangement.

Respective supporting members, e.g. made of an elastic buffer of rubber, foam, elastomer or the like without spring elements can be provided in other unshown embodiments. The supporting members may also be made from a component according to FIG. 7, e.g. with only six spring elements, in which the center intervening space between the inner neighboring spring elements remains free so that screw domes from the base parts can extend into the center intervening space. In the embodiments of the supporting member shown in FIGS. 9 to 11 the individual spring elements, which are shown in FIGS. 4 and 5 as spring elements 20 to 25, need not be arranged in a row, but they can be in a circle as shown in FIG. 9 or a polygon, e.g. a triangle or rectangle as shown in FIGS. 10 and 11 respectively. In the other embodiment shown in FIG. 9 the spring elements 320, 321, 322, 323, 324, 325 are arranged parallel and spaced from each other in a circle in the supporting member 311, while in the embodiment of supporting member 411 shown in FIG. 10 the spring elements 420, 421, 422, 423, 424, 425 are arranged parallel and spaced from each other on a triangle. In the embodiment shown in FIG. 1 the spring elements 520, 521, 522, 523, 524, 525 are arranged parallel to each other and in a rectangular arrangement in supporting member 511. The base parts are adjusted according to the arrangement of the spring elements. Also in other embodiments of the invention other arrangements of the supporting members can be used instead of the four-cornered arrangement shown in FIG. 2. For example, the supporting members can be arranged around a circle with spacing. The center of the circle can coincide, for example, with the central axis of the hand tool 1. Also several equally formed supporting members can be assembled in the form of at least one circular ring or in as row in at least one linear arrangement.

The disclosures of German Patent Applications 197 07 938.5 of Feb. 27, 1997 and 198 00 042.1 of Jan. 2, 1998 are hereby explicitly incorporated by reference. These German Patent Applications disclose the same invention as described herein and claimed in the claims appended hereinbelow and are the basis for a claim of priority for the instant invention under 35 U.S.C. 119.

While the invention has been illustrated and described as embodied in a motor driven hand tool, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A motor driven hand tool comprising a hand tool housing (2), an oscillatory work tool carrier (10) arranged on the hand tool housing (2) and at least one elastic supporting member (11 to 14,111, 211, 311, 411, 511) connecting the oscillatory work tool carrier to the hand tool housing (2) in order to hold the oscillatory work tool carrier on the hand tool housing;

wherein said at least one elastic supporting member (11 to 14, 111, 211, 311, 411, 511) each comprise a one-piece plastic part, said one-piece plastic part consists of at least one approximately rod-shaped spring element (20 to 25; 120,125; 220 to 225, 234 and 235; 320 to 325; 420 to 425; 520 to 525) and transversely extending base parts (15,26; 115,126; 215,226) at opposite ends of the at least one approximately rod-shaped spring element, and said base parts contact on respective facing surfaces of the hand tool housing and the work tool carrier and are formed for releasable attachment of said at least one elastic supporting member with the hand tool housing and the work tool carrier.

2. The hand tool as defined in claim 1, wherein said transversely extending base parts (15,26; 115,126; 215,226) are provided with passages (27, 28; 127; 227) for attaching screws.

3. The hand tool as defined in claim 1, wherein said at least one approximately rod-shaped spring element consists of a plurality of approximately rod-shaped spring elements (20 to 25; 120,125; 220 to 225, 234 and 235) arranged approximately parallel to each other and one after the other in a row.

4. The hand tool as defined in claim 3, wherein said at least one supporting member (11 to 14, 111, 211) has at least one damping part (29; 129; extending between said spring elements and said at least one damping part (29; 129; 229) is braced or supported between said base parts (15, 26; 115, 126; 215, 226).

5. The hand tool as defined in claim 4, wherein said at least one damping part (29; 129; 229) extends from one (15; 115; 215) of said base parts to another (26; 126; 226) of said base parts.

6. The hand tool as defined in claim 4, wherein said at least one damping part (29;229) fills a region between said spring elements (20 to 25; 120,125; 220 to 225, 234 and 235).

7. The hand tool as defined in claim 4, wherein said at least one damping part (29; 129; 229) fits without rigid connection between said spring elements (20 to 25; 120,125; 220 to 225, 234 and 235) and/or said transversely extending base parts (15,26; 115,126; 215,226).

8. The hand tool as defined in claim 4, wherein said at least one damping part (29; 129; 229) is formed from a central part (133) arranged between said base parts (15,26; 115,126; 215,226) and said central part (133) extends with transverse spacing from said spring elements (120,125).

9. The hand tool as defined in claim 1, wherein said at least one approximately rod-shaped spring element (20 to 25; 120,125; 220 to 225, 234 and 235) has a circular cross-section.

10. The hand tool as defined in claim 1, wherein said at least one approximately rod-shaped spring element consists of a plurality of approximately rod-shaped spring elements (320, 321, 322, 323, 324, 325) arranged approximately parallel to each other and in a circle.

11. The hand tool as defined in claim 1, wherein said at least one approximately rod-shaped spring element (420, 421, 422, 423, 424, 425; 520, 521, 522, 523, 524, 525) consists of a plurality of approximately rod-shaped spring elements arranged approximately parallel to each other and in a polygonal arrangement.

12. The hand tool as defined in claim 11, wherein said polygonal arrangement is a triangular or rectangular arrangement.

13. The motor driven hand tool as defined in claim 1, consisting of an oscillatory grinder.

* * * * *